United States Patent [19]

Burborough

[11] Patent Number: 4,512,727

[45] Date of Patent: Apr. 23, 1985

[54] FUEL INJECTION PUMP OF THE ROTARY DISTRIBUTOR TYPE

[75] Inventor: William R. Burborough, Gillingham, England

[73] Assignee: Lucas Industries public limited company, Birmingham, England

[21] Appl. No.: 553,131

[22] Filed: Nov. 18, 1983

[30] Foreign Application Priority Data

Dec. 21, 1982 [GB] United Kingdom ..... 8236276

[51] Int. Cl.[3] ..... F04B 19/02; F02M 39/00; F02N 17/00

[52] U.S. Cl. ..... 417/462; 417/503; 123/450; 123/179 L

[58] Field of Search ..... 417/462, 503; 123/179 L, 366, 450, 504

[56] References Cited

U.S. PATENT DOCUMENTS

| | | | |
|---|---|---|---|
| 2,853,947 | 9/1958 | Evans | 417/503 X |
| 3,489,091 | 1/1970 | Becker | 417/503 X |
| 4,083,345 | 4/1978 | Davis | 123/179 L X |
| 4,310,291 | 1/1982 | Green et al. | 123/179 L X |
| 4,348,995 | 9/1982 | Jefferson et al. | 417/462 X |
| 4,358,256 | 11/1982 | Jefferson | 417/462 |
| 4,362,140 | 12/1982 | Jefferson et al. | 417/462 X |
| 4,401,084 | 8/1983 | Jarrett et al. | 417/462 X |
| 4,422,425 | 12/1983 | Jefferson | 417/462 X |
| 4,446,835 | 5/1984 | Mowbray | 417/462 X |

FOREIGN PATENT DOCUMENTS

| | | | |
|---|---|---|---|
| 916617 | 1/1963 | United Kingdom | 417/462 |
| 2058947 | 4/1981 | United Kingdom | 123/450 |

*Primary Examiner*—William L. Freeh
*Assistant Examiner*—Paul F. Neils

[57] ABSTRACT

A fuel injection pump of the rotary distributor type includes a rotary distributor member having a bore in which is slidable a plunger which can be actuated by a cam lobe. A stop ring is provided to limit the outward movement of the plunger by fuel which is supplied to the bore through an inlet passage in the distributor member when the latter is in register with an inlet port. The stop ring has a surface which will permit further outward movement of the plunger following cessation of fuel flow through the inlet port and passage and such additional movement to allow an excess of fuel to be delivered is allowed by fuel flow through an additional inlet passage. This passage is controlled by valve means which is preferably only opened when the engine is at rest.

3 Claims, 3 Drawing Figures

FUEL INJECTION PUMP OF THE ROTARY DISTRIBUTOR TYPE

This invention relates to fuel injection pumps of the rotary distributor type for supplying fuel to compression ignition engines the pumps comrprising a body part, a rotary distributor member in the body part, the distributor member being arranged in use to be driven in timed relationship with an associated engine, a radial bore in the distributor member and a plunger slidable therein, a cam follower at the outer end of the plunger, an annular cam ring mounted in the body, said cam ring having a cam lobe on its internal peripheral surface whereby as the distributor member rotates inward movement will be imparted to the plunger, a delivery passage in the distributor member and an outlet port in the body, said delivery passage being positioned to register with said outlet port to receive fuel displaced from the bore by the inward movement of the plunger, an inlet passage in the distributor member, said inlet passage communicating with said bore, an inlet port in the body, said inlet passage communicating with said inlet port to allow fuel flow to said bore during the time the plunger is permitted to move outwardly by the cam lobe, a low pressure pump for supplying fuel to said inlet port, throttle means for controlling the quantity of fuel supplied to said bore and a stop plate mounted in the body, said stop plate defining a stop surface engageable by the cam follower to control the maximum allowed outward movement of the plunger.

With the above type of pump the stop plate serves as the maximum fuel stop and therefore acts to determine the maximum amount of fuel which can be supplied by the pump to the associated engine irrespective of the setting of said throttle means. In order to start certain types of engines it is necessary to supply an amount of fuel in excess of the normal maximum amount. The radial dimension of the stop surface of the stop plate varies throughout its length and therefore the angular setting of the stop surface about the axis of rotation of the distributor member determines the outward movement of the plunger which takes place before closure of the inlet port. The stop plate is angularly adjustable to allow adjustment of the maximum fuel quantity when the pump is manufactured and it is possible to arrange for such movement to take place when it is required to start the associated engine. However the mechanism which is required to achieve such adjustment is complex and must be of a robust nature in order to withstand the stresses imposed upon it during the use of the pump.

The object of the present invention is to provide a pump of the kind specificed in a simple and convenient form.

According to the invention in a pump of the kind specified said stop surface has a radial dimension which various throughout the length of the surface, the pump further comprising an additional inlet port formed in the body, said additional inlet port being positioned to register with said inlet passage or a further such passage at least after the communication of the first mentioned inlet port with the inlet passage has been broken and valve means for controlling fuel flow through said additional inlet port.

An example of a fuel injection pump in accordance with the invention wll now be described with reference to the accompany drawings in which.

Figure 1:
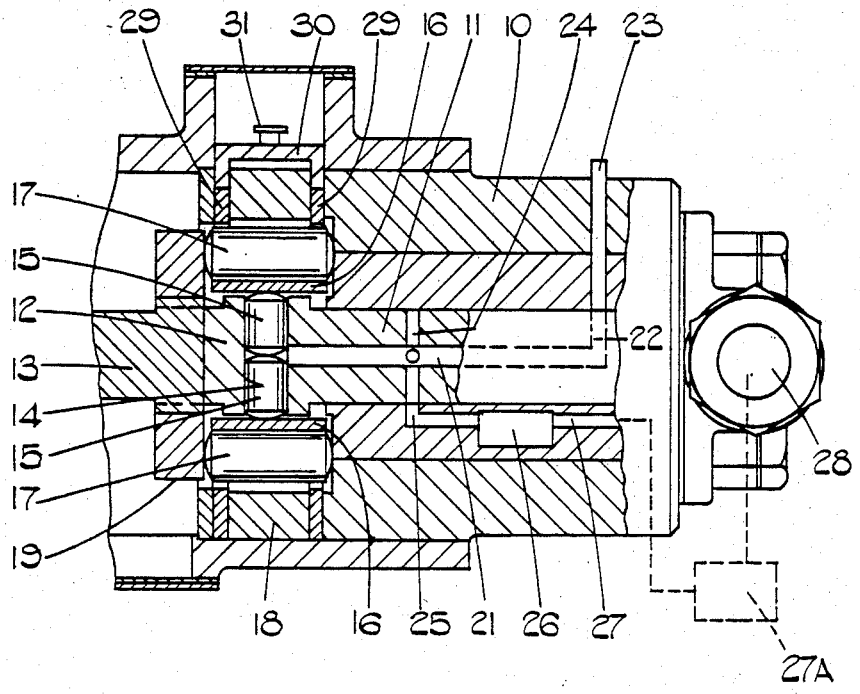
FIG. 1 is a sectional side elevation of the pump.

Referring to the drawings the pump comprises a body 10 in which is formed a bore carrying a rotary cylindrical distributor member 11. The distributor member is coupled to an input shaft 13 which extends from the body part and which is adapted to be driven in timed relationship with an engine with which the pump is associated. Formed within an enlarged portion 12 of the distributor member is a transverse bore 14 in which is mounted a pair of reciprocable plungers 15 which are arranged to be moved inwardly as the distributor member rotates, through the intermediary of cam followers respectively, by cam lobes formed on the internal peripheral surface of an annular cam ring 18 which is mounted for angular adjustment within the body. The profile of a single cam lobe of the cam ring is seen at 29 in FIG. 3. Each cam follower includes a shoe 16 and a roller 17 and the followers are located in slots respectively formed in a part 19 driven by the input shaft.

Also formed in the distributor member 11 is a longitudinally extending passage 21 which at one end is in communication with the bore 14 and at its other end is in communication with a radially disposed delivery passage 22. The delivery passage 22 is arranged to register in turn with a plurality of equiangularly spaced outlet ports 23 which in use, are connected by pipelines respectively to injection nozzles mounted on the associated engine. The aforesaid registration of the passage 22 with one of the outlet ports takes place during the whole time the plungers 15 are being moved inwardly so that liquid fuel contained in the bore 14 will be displaced to a combustion space of the engine.

At another point the longitudinal passage 21 is in communication with a plurality of equi-angularly spaced and radially disposed inlet passages 24. The passages 24 are arranged to register in turn with an inlet port 25 which is formed in the body. In practice in order to facilitate filling of the bore 14, two inlet ports 25 are provided these being angularly spaced by an amount equal to the angular spacing of the inlet passages 24 which in the case of a pump for supplying fuel to a four cylinder engine is 90°.

The inlet ports 25 communicate by way of a passage 25A, with a throttle device 26 the setting of which is controlled by a speed responsive governor. The device 26 communicates with the outlet 27 of a low pressure supply pump 27A having an inlet 28, the supply pump being located in the body 10 of the pump. The arrangement is such that when the inlet passages 24 register with the inlet ports, fuel will flow from the outlet of the low pressure pump to the transverse bore 14 to effect outward movement of the plungers. The aforesaid registration takes place only during the time when the delivery passage 22 is out of register with an outlet port 23 and during the time when the rollers 17 are clear of the cam lobes. By adjusting the setting of the device 26, the rate at which fuel can flow to the bore 14 can be controlled and hence also the amount of fuel delivered to the engine.

In order to control the maximum amount of fuel which can be supplied by the pump to the associated engine, a pair of stop plates 29 are positioned on the opposite sides of the cam ring 18. The stop plates 29 are interconnected by a bridge member 30 on which is mounted an actuating peg 31 connected to an adjustment device not shown. The stop plates 29 define, as will be seen in FIG. 3, stop surfaces which are referenced 48, having a radial dimension which in fact increases in the direction of rotation of the distributor member, the direction of rotation being indicated by the arrow 49. The stop plates are angularly adjustable relative to the body and will be adjusted when the pump is manufactured so that a particular pump will be unable to supply more than a predetermined amount of fuel irrespective of the setting of the throttle device 26.

Figure 3:
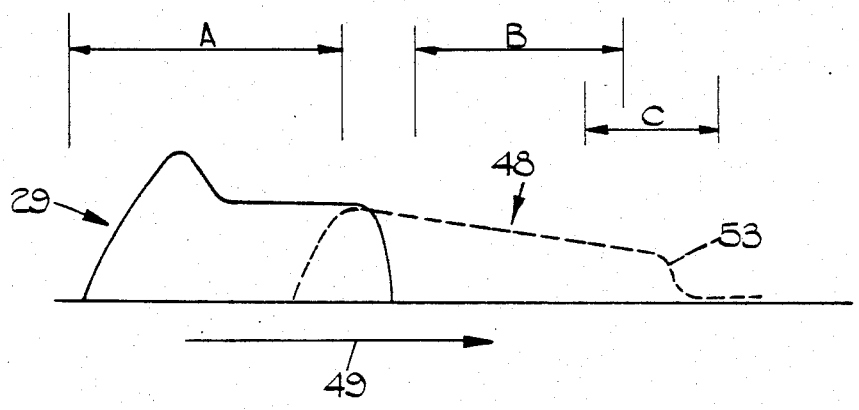
FIG. 3 is a diagram showing the shape of parts of the apparatus of FIG. 1 and also the timing diagram.

In FIG. 3 above the diagram of the cam lobe 29 and the stop surface 48 is a representation of the periods during which the delivery passage is open to an outlet port 23 and the inlet passages 24 are open to the inlet ports 25. The delivery passage 22 is open to an outlet port 23 during the period which is referenced A and the inlet ports and passages are in communication with each other during the period referenced B. Since the position of the inlet ports 25 is fixed in the body the angular setting of the stop plates 29 determines the maximum amount of fuel which can be supplied to the associated engine.

Figure 2:
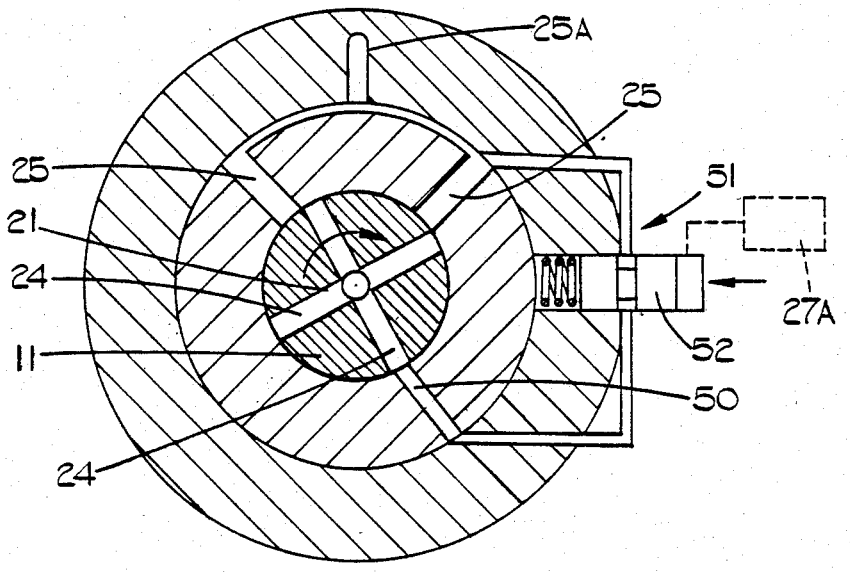
FIG. 2 is a cross section through part of the pump seen in FIG. 1.

Turning now particularly to FIG. 2, an additional inlet port 50 is provided in the body and this opens onto the periphery of the distributor member at a position to communicate with an inlet passage 24 at least after the communication of the inlet passages 24 and the inlet ports 25 has ceased. In the example illustrated, the additional port 50 communicates with an inlet passage 24 before the communication of the inlet ports 25 and the passages 24 is broken. The port 50 communicates with the passage 25A by way of a valve generally indicated at 51 and which comprises a spool 52 which is biased by a coiled compression spring to a position in which fuel flow can take place to the additional port 50. The spool is biased to the closed position by means of fuel under pressure derived from the outlet of the low pressure pump. FIG. 3 shows the period during which the additional port 50 is in communication with an inlet passage 24, this period being referenced C. It will be noted from FIG. 3, that the stop surface defines a step 53 which coincides with the period during which the additional inlet port is open to an inlet passage 24 and as a result when the spool is in the open position, the plungers can move outwardly an additional amount, this additional amount corresponding to the extra amount of fuel required for starting purposes.

It will be appreciated that the additional flow of fuel takes place by way of the throttle device 26. However, this when attempting to start the engine will be at its maximum setting due to the action of the governor. When the associated engine starts, the outlet pressure of the low pressure pump will increase and the spool will move against the action of its spring to the closed position so that the supply of additional fuel ceases. It is preferred however to control the spool by an additional valve and to arrange that the spool can be moved to the closed position at a pressure which is below the minimum pressure which may be developed by the low pressure pump during operation of the engine. The additional valve will be of the latched variety to ensure that the spool cannot move to the open position except when the engine is at rest. It may be desirable to arrange that the additional valve is also responsive to engine temperature.

I claim:

1. A fuel injection pump of the rotary distributor type comprising a body part, a rotary distributor member in the body part, the distributor member being arranged in use to be driven in timed relationship with an associated engine, a radial bore in the distributor member and a plunger slidable therein, a cam follower at the outer end of the plunger, an annular cam ring mounted in the body, said cam ring having a cam lobe on its internal peripheral surface whereby as the distributor member rotates inward movement will be imparted to the plunger, a delivery passage in the distributor member communicating with said bore and a plurality of outlet ports in the body, said delivery passage being positioned to register with said outlet ports to receive fuel displaced from the bore by the inward movement of the plunger, a plurality of inlet passages in the distributor member, said inlet passages communicating with said bore, an inlet port in the body, said inlet port communicating with an inlet passage to allow fuel flow to said bore during the time the plunger is permitted to move outwardly by the cam lobe, a low pressure pump for supplying fuel to said inlet port, throttle means for controlling the quantity of fuel supplied to said bore, a stop plate mounted in the body, said stop plate defining a stop surface engageable by the cam follower to control the maximum allowed outward movement of the plunger, said stop surface having a radial dimension which varies throughout the length of the surface, the pump further comprising an additional inlet port formed in the body, said additional inlet port being positioned to register with an inlet passage at least after the communication of the first mentioned inlet port with an inlet passage has been broken and valve means for controlling fuel flow through said additional inlet port.

2. A pump according to claim 1 in which the radial dimension of said stop surface increases in the direction of rotation of the distributor member.

3. A pump according to claim 2 in which said valve means is responsive to the outlet pressure of said low pressure pump.

* * * * *